US010750855B2

(12) United States Patent
Bender

(10) Patent No.: US 10,750,855 B2
(45) Date of Patent: Aug. 25, 2020

(54) NOTEBOOK COMPUTER LAP TABLE

(71) Applicant: Bruce Bender, Globe, AZ (US)

(72) Inventor: Bruce Bender, Globe, AZ (US)

( * ) Notice: Subject to any disclaimer, the term of this patent is extended or adjusted under 35 U.S.C. 154(b) by 0 days.

(21) Appl. No.: 16/254,005

(22) Filed: Jan. 22, 2019

(65) Prior Publication Data

US 2020/0229590 A1 Jul. 23, 2020

(51) Int. Cl.

| | |
|---|---|
| ***A47B 57/00*** | (2006.01) |
| ***A47B 23/00*** | (2006.01) |
| ***A47B 13/08*** | (2006.01) |

(52) U.S. Cl.

CPC ..... *A47B 23/002* (2013.01); *A47B 13/088* (2013.01); *A47B 23/001* (2013.01)

(58) Field of Classification Search

CPC ..... A47B 23/00; A47B 23/001; A47B 23/002; A47B 2023/005; A47B 2023/049

USPC ..... 108/92, 93, 99

See application file for complete search history.

(56) References Cited

U.S. PATENT DOCUMENTS

| | | | | |
|---|---|---|---|---|
| 4,903,222 | A | 2/1990 | Carter | |
| 5,894,406 | A | 4/1999 | Blend | |
| 6,490,154 | B2 | 12/2002 | Thompson | |
| 7,007,612 | B2 | 3/2006 | Mallory | |
| 7,567,432 | B1 | 7/2009 | Tabasso | |
| 8,167,131 | B1 * | 5/2012 | Anderson | A45C 5/03 190/102 |
| D689,497 | S | 9/2013 | Park | |
| 8,724,312 | B2 | 5/2014 | Jones | |
| 9,364,084 | B2 * | 6/2016 | Rege | A47B 61/04 |
| 2012/0024200 | A1 * | 2/2012 | Raney | A47B 23/002 108/14 |

OTHER PUBLICATIONS

Merriam Webster Online Dictionary, definition of "Along" (Year: 2020).*

* cited by examiner

*Primary Examiner* — Matthew W Ing

(57) ABSTRACT

A notebook computer lap table for facilitating portable use of a notebook computer with an external keyboard includes a pair of platforms comprising a base platform and a shelf platform. A support assembly comprises a left support and a right support coupled to an upper side of the base platform adjacent a left edge and a right edge, respectively. The base platform is configured to receive a notebook computer between the left support and the right support. The support assembly is configured to extend above the keyboard of the notebook computer. The shelf platform has a closed position resting on the support assembly parallel with the base platform over the keyboard and an alternate open position. The shelf platform in the closed position is configured to support an external keyboard.

6 Claims, 5 Drawing Sheets

NOTEBOOK COMPUTER LAP TABLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to lap tables and more particularly pertains to a new lap table for providing a portable means of using a notebook computer with an external keyboard.

BRIEF SUMMARY OF THE INVENTION

An embodiment of the disclosure meets the needs presented above by generally comprising a pair of platforms comprising a base platform and a shelf platform. Each of the pair of platforms has an upper side, a lower side, a left edge, right edge, a front edge, and a rear edge. A support assembly is coupled to the pair of platforms and comprises a left support coupled to the upper side of the base platform adjacent the left edge and a right support coupled to the upper side of the base platform adjacent the right edge. The base platform is configured to receive a notebook computer on the upper side between the left support and the right support. The support assembly is configured to extend above the keyboard of the notebook computer. The shelf platform has a closed position resting on the support assembly parallel with the base platform and an alternate open position. The shelf platform in the closed position is configured to rest over the keyboard of the notebook computer to support an external keyboard on the upper side.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
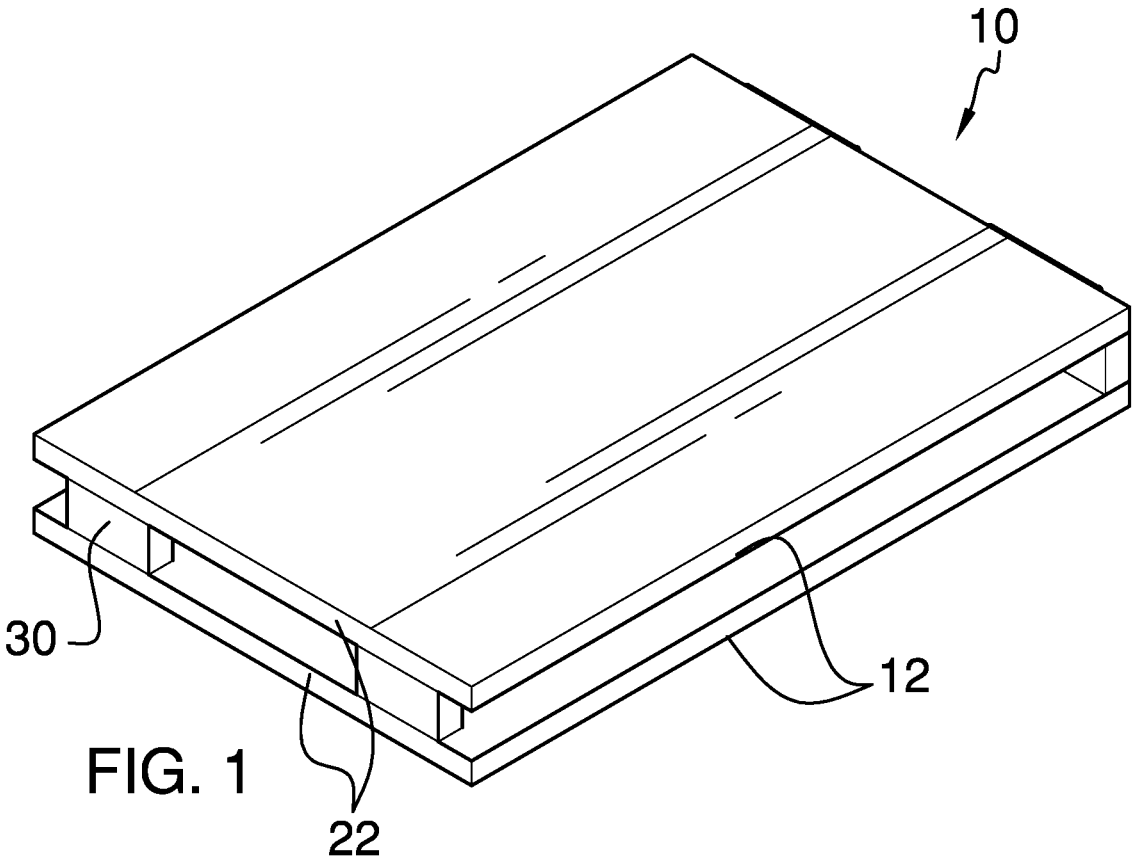
FIG. 1 is an isometric view of a notebook computer lap table according to an embodiment of the disclosure.
Figure 2:
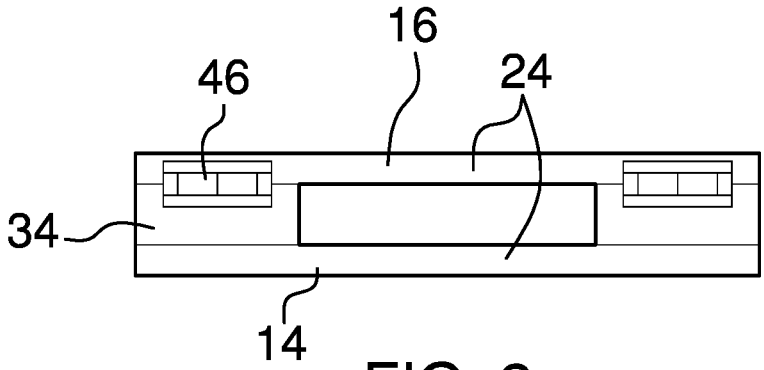
FIG. 2 is a side elevation view of an embodiment of the disclosure.
Figure 3:
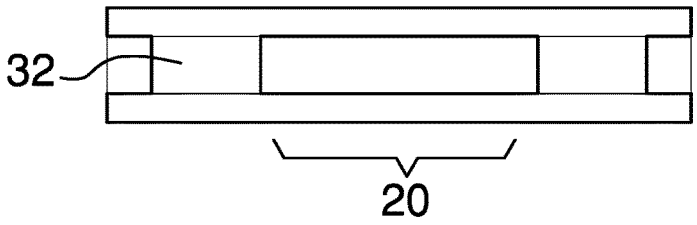
FIG. 3 is a side elevation view of an embodiment of the disclosure.
Figure 4:
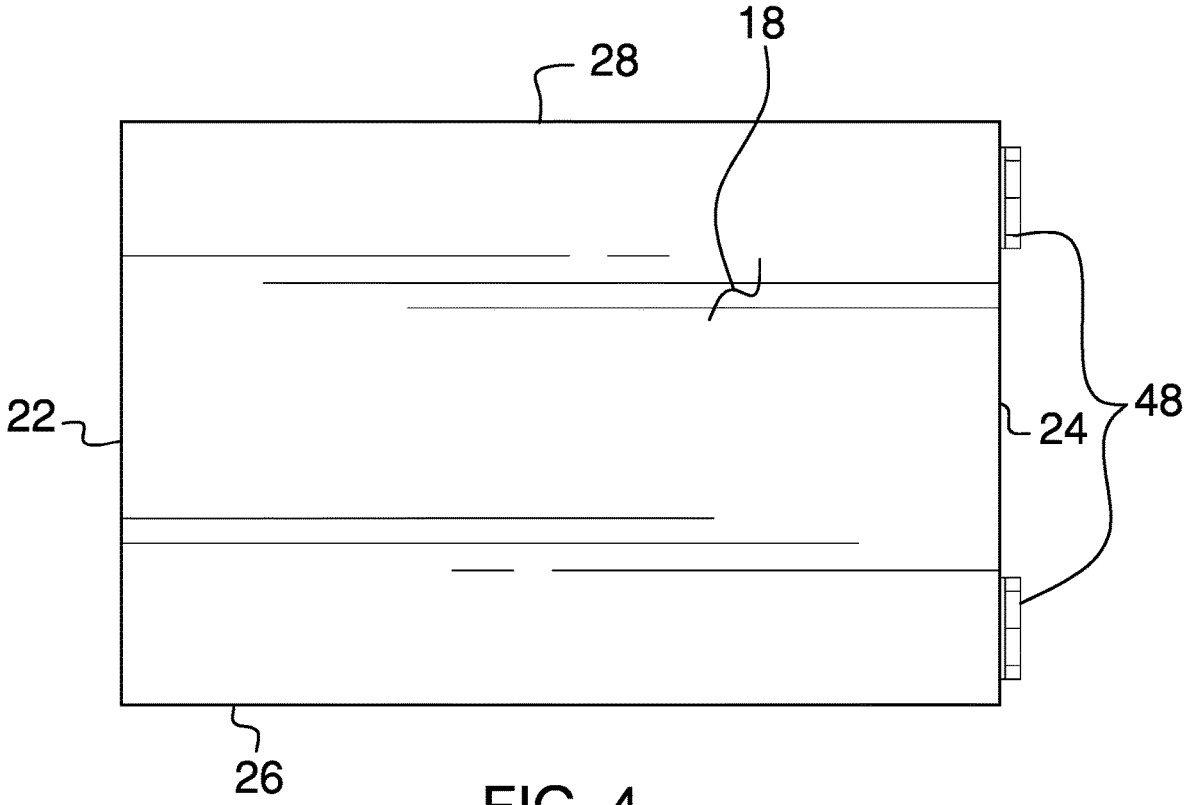
FIG. 4 is a top plan view of an embodiment of the disclosure.
Figure 5:
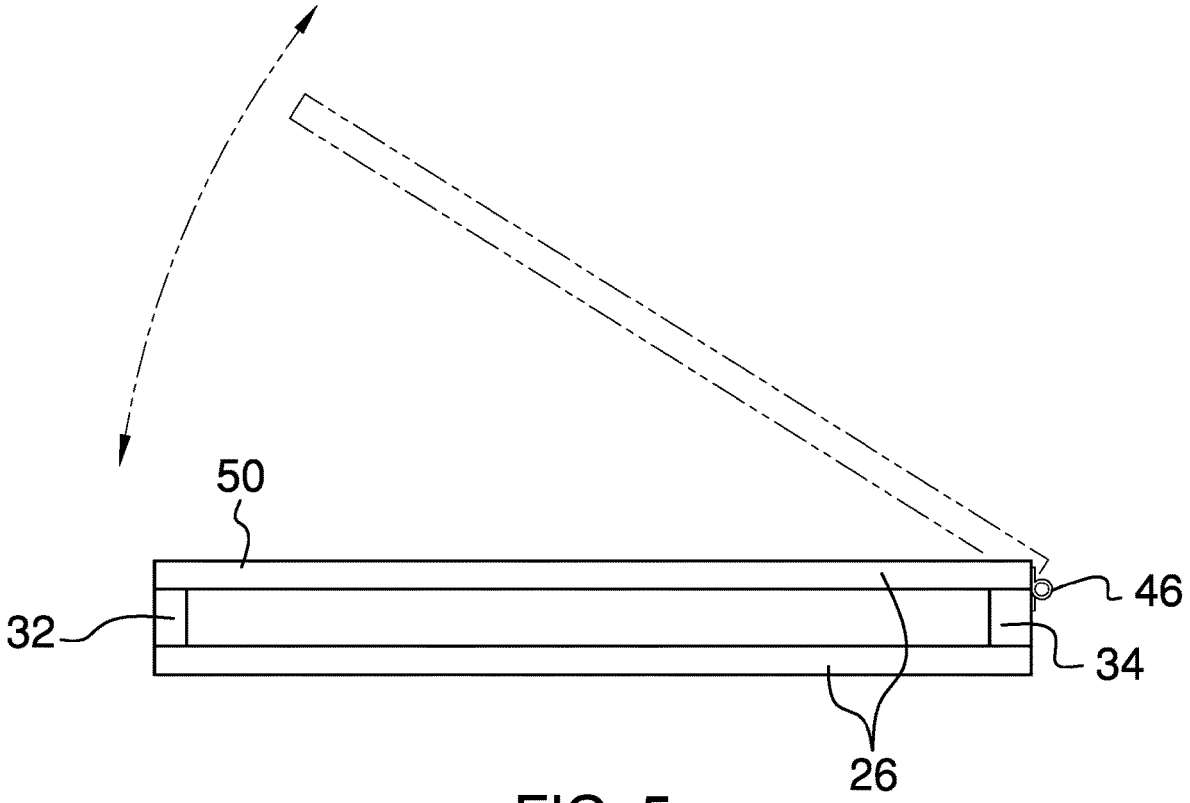
FIG. 5 is a front elevation view of an embodiment of the disclosure.
Figure 6:
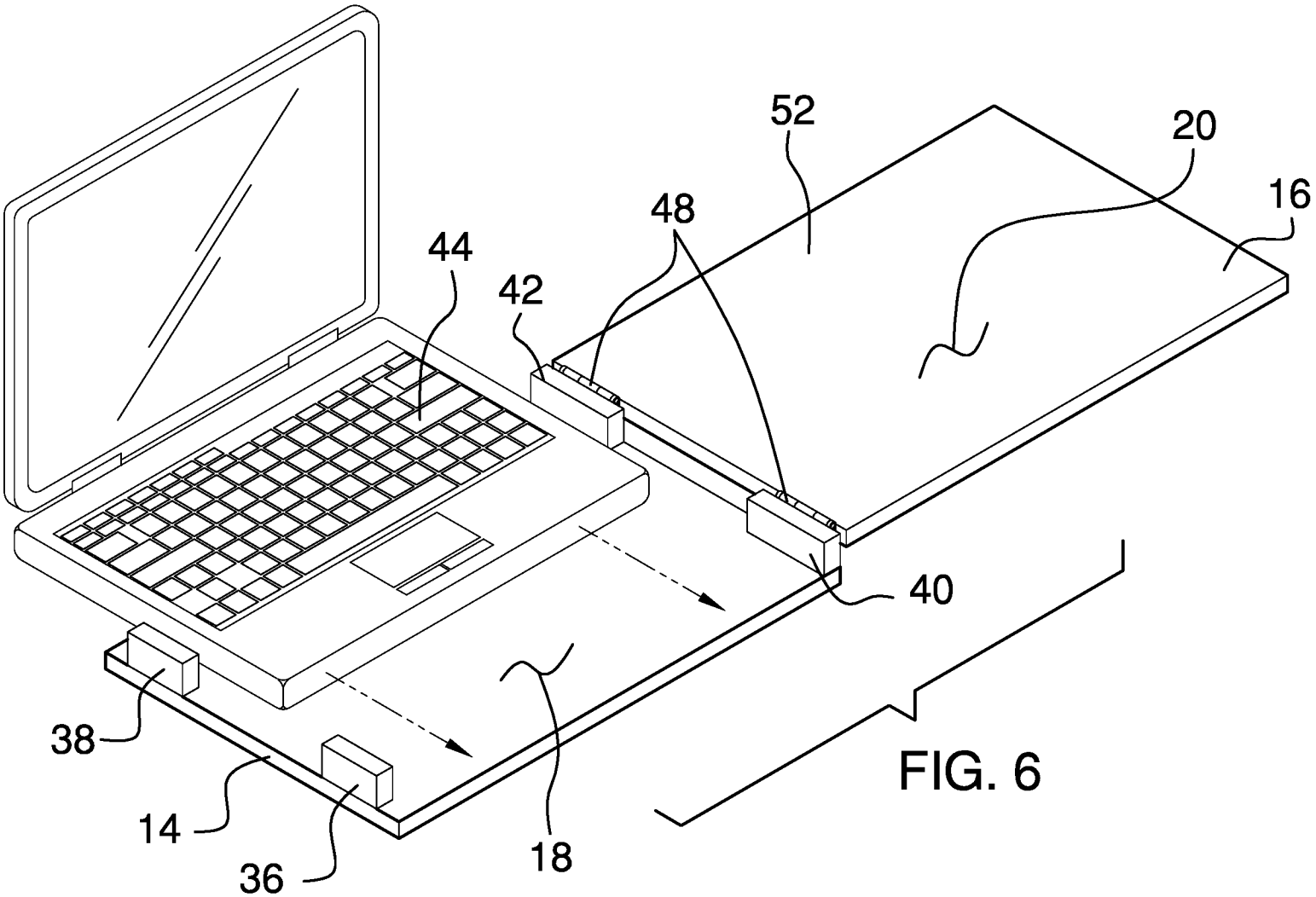
FIG. 6 is a perspective view of an embodiment of the disclosure in use.
Figure 7:
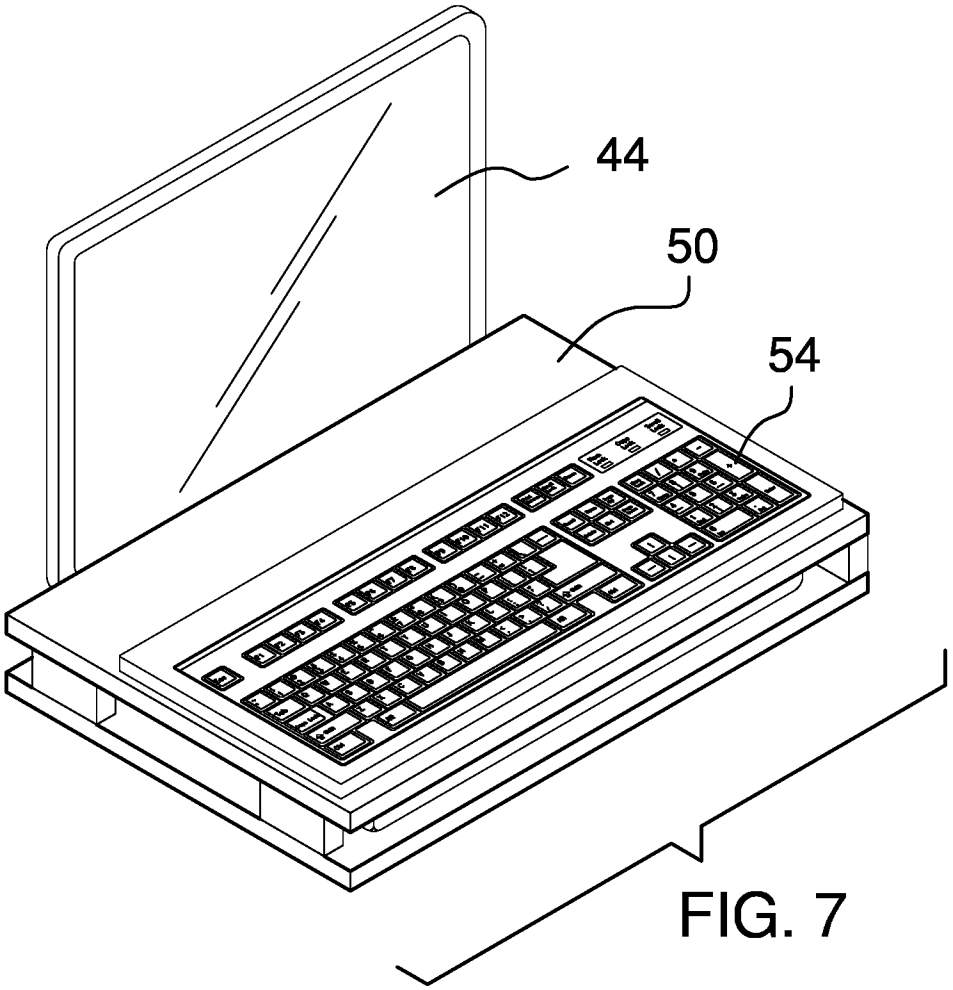
FIG. 7 is a perspective view of an embodiment of the disclosure in use in an alternative position.

With reference now to the drawings, and in particular to FIGS. 1 through 7 thereof, a new lap table embodying the principles and concepts of an embodiment of the disclosure and generally designated by the reference numeral 10 will be described.

As best illustrated in FIGS. 1 through 7, the notebook computer lap table 10 generally comprises a pair of platforms 12 comprising a base platform 14 and a shelf platform 16 each having an upper side 18, a lower side 20, a left edge 22, right edge 24, a front edge 26, and a rear edge 28. A support assembly 30 is coupled to the pair of platforms 12 and comprises a left support 32 coupled to the upper side 18 of the base platform adjacent the left edge 22 and a right support 34 coupled to the upper side 18 of the base platform adjacent the right edge 24. The left support 32 may have a left front support 36 spaced from the front edge 26 and a left rear support 38 spaced from the rear edge 28 and the right support 34 may have a right front support 40 coupled adjacent the front edge 26 and a right rear support 42 coupled adjacent the rear edge 28. The base platform 14 is configured to receive a notebook computer 44 on the upper side 18 between the left support 32 and the right support 34. The positioning of the support assembly 30 is configured to minimize the necessary size of the pair of platforms 12 to receive the notebook computer 44 while maintaining access to ports on the sides of the notebook computer 44. The support assembly 30 is configured to extend above the keyboard of the notebook computer 44.

A hinge 46 is coupled to the support assembly 30 and the shelf platform 16. The hinge 46 is coupled to the right support 34 and the right edge 24 of the shelf platform adjacent the lower side 20. The hinge 46 may be a pair of hinges 48 coupled to each of the right front support 40 and the right rear support 42. The shelf platform 16 swingably moves between a closed position 50 resting on the support assembly 30 parallel with the base platform 14 and an alternate open position 52.

In use, the notebook computer 44, open and ready to use, is placed on the base platform 14 when the shelf platform 16 is in the alternate open position 52. The shelf platform 16 is moved to the closed position 50 in which it rests over the keyboard of the notebook computer 44 to support an external keyboard 54 on the upper side 18. A user may thus use the external keyboard 54 of her liking without sacrificing the ability to use her notebook computer 44 in her lap.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A notebook computer lap table comprising:

a pair of platforms, the pair of platforms comprising a base platform and a shelf platform, each of the pair of platforms having an upper side, a lower side, a left edge, right edge, a front edge, and a rear edge;

a support assembly coupled to the pair of platforms, the support assembly comprising a left support coupled to the upper side of the base platform adjacent the left edge and a right support coupled to the upper side of the base platform adjacent the right edge;

wherein the base platform is configured to receive a notebook computer on the upper side between the left support and the right support, the support assembly is configured to extend above the keyboard of the notebook computer, the shelf platform has a closed position resting on the support assembly parallel with the base platform and an alternate open position, and the shelf platform in the closed position is configured to rest over the keyboard of the notebook computer to support an external keyboard on the upper side, the shelf platform being spaced from the base platform such that the shelf platform is configured to extend along a bottom of a screen of the notebook computer when the shelf platform is in the closed position such that the screen of the notebook computer is visible when the shelf platform is in the closed position; and a hinge coupled to the support assembly and the shelf platform, the shelf platform swingably moving between the closed position resting on the support assembly parallel with the base platform and the alternate open position, the hinge being coupled to the right support and the right edge of the shelf platform adjacent the lower side.

2. The notebook computer lap table of claim 1 further comprising the left support having a left front support and a left rear support and the right support having a right front support and a right rear support.

3. The notebook computer lap table of claim 1 further comprising the left support having a left front support and a left rear support and the right support having a right front support and a right rear support, the hinge being a pair of hinges coupled to each of the right front support and the right rear support.

4. The notebook computer lap table of claim 3 further comprising the left front support being spaced from the front edge and the left rear support being spaced from the rear edge, the right front support being coupled adjacent the front edge and the right rear edge being coupled adjacent the rear edge.

5. The notebook computer lap table of claim 1 further comprising each of the pair of platforms and the support assembly being rectangular prismatic.

6. A notebook computer lap table comprising:

a pair of platforms, the pair of platforms comprising a base platform and a shelf platform, each of the pair of platforms having an upper side, a lower side, a left edge, right edge, a front edge, and a rear edge;

a support assembly coupled to the pair of platforms, the support assembly comprising a left support coupled to the upper side of the base platform adjacent the left edge and a right support coupled to the upper side of the base platform adjacent the right edge, the left support having a left front support spaced from the front edge and a left rear support spaced from the rear edge and the right support having a right front support coupled adjacent the front edge and a right rear support coupled adjacent the rear edge;

a hinge coupled to the support assembly and the shelf platform, the hinge being coupled to the right support and the right edge of the shelf platform adjacent the lower side, the hinge being a pair of hinges coupled to each of the right front support and the right rear support, the shelf platform swingably moving between a closed position resting on the support assembly parallel with the base platform and an alternate open position; and wherein the base platform is configured to receive a notebook computer on the upper side between the left support and the right support, the support assembly is configured to extend above the keyboard of the notebook computer, and the shelf platform in the closed position is configured to rest over the keyboard of the notebook computer to support an external keyboard on the upper side, the shelf platform being spaced from the base platform such that the shelf platform is configured to extend along a bottom of a screen of the notebook computer when the shelf platform is in the closed position such that the screen of the notebook computer is visible when the shelf platform is in the closed position, wherein each of the pair of platforms and the support assembly is rectangular prismatic.

* * * * *